US005697344A

United States Patent [19]

Ikari

[11] Patent Number: 5,697,344

[45] Date of Patent: Dec. 16, 1997

[54] ENGINE FUEL DISTRIBUTING PIPE STRUCTURE

[75] Inventor: Jiro Ikari, Toyota, Japan

[73] Assignee: Toyota Jidosha Kabushiki Kaisha, Toyota, Japan

[21] Appl. No.: 590,793

[22] Filed: Jan. 24, 1996

[30] Foreign Application Priority Data

Jan. 26, 1995 [JP] Japan ..... 7-010925

[51] Int. Cl.[6] ..... F02M 55/02

[52] U.S. Cl. ..... 123/468

[58] Field of Search ..... 123/295, 456, 123/468, 469, 470, 432

[56] References Cited

U.S. PATENT DOCUMENTS

| | | | |
|---|---|---|---|
| 3,194,221 | 7/1965 | Dinger et al. | 123/469 |
| 3,402,703 | 9/1968 | Dickerson et al. | 123/469 |
| 3,527,263 | 9/1970 | Carney et al. . | |
| 3,924,583 | 12/1975 | Jardin | 123/469 |
| 4,384,557 | 5/1983 | Johnson | 123/468 |
| 4,445,713 | 5/1984 | Bruning | 123/469 |
| 5,335,635 | 8/1994 | Kadoi et al. | 123/295 |

FOREIGN PATENT DOCUMENTS

| | | | |
|---|---|---|---|
| 472515 | 2/1992 | European Pat. Off. . | |
| 59-65974 | 5/1984 | Japan . | |
| 1124365 | 8/1989 | Japan . | |
| 444439 | 4/1992 | Japan . | |
| 5-195906 | 8/1993 | Japan | 123/468 |
| 1139134 | 1/1969 | United Kingdom . | |

*Primary Examiner*—Thomas N. Moulis
*Attorney, Agent, or Firm*—Kenyon & Kenyon

[57] ABSTRACT

A pair of intake valves 13 and a pair of exhaust valves 14 are arranged in a cylinder head 10, and a fuel injection nozzle 23 with a narrow diameter is mounted in a narrow space 401 between them. A fuel supply port 234 is provided near to the nozzle's fuel injection orifice 232, and with the nozzle 23 mounted, the nozzle's fuel supply port 234 is positioned within the narrow space 401. A fuel supply pipe 26, connected to the fuel supply port 234, has a first part portion 261 extending between valve lifter casings 11 and 12, another portion 262 leading from the vicinity of a cylinder head 10 to the camshafts 20 and 21, a curved portion 263 extending over an exhaust-side camshaft 21, and another portion 264 supported by a grommet 27 on the cylinder head 10.

26 Claims, 2 Drawing Sheets

ENGINE FUEL DISTRIBUTING PIPE STRUCTURE

BACKGROUND OF THE INVENTION

1. Field of the Invention

The present invention relates generally to a fuel distributing pipe structure for supplying fuel to an internal combustion engine, and more particularly to a fuel distributing pipe structure for supplying fuel to an engine fuel injection nozzle.

2. Description of the Related Art

Generally, in diesel engines where fuel is supplied directly into a combustion chamber by a fuel injection nozzle, each nozzle is mounted on the cylinder block to be in the center of a combustion chamber and is fixed on the cylinder block with a fixing device. Each fuel injection nozzle is connected to a fuel supply pipe for supplying compressed fuel from a fuel injection pump and to a fuel return pipe for returning excess fuel to the fuel tank.

Normally, each fuel injection nozzle has a fuel injection orifice at its lower end, a fuel supply port adjacent to the fuel injection orifice, and a fuel passage joining the fuel supply port and the fuel injection orifice. The fuel passage is very narrow and formation of the fuel passage requires precise machining. Where the fuel passage is long, it is difficult to maintain high precision machine work over the entire length. Therefore, to suppress fluctuations in the fuel injection characteristics resulting from uneven machining, the fuel supply port needs to be located as near as possible to the fuel injection orifice.

Although the fuel supply pipe must be connected to the lower end of the nozzle's main body, this has not caused any significant problems in conventional engines having two-valve type valve moving mechanisms because there has been sufficient room between the valve lifter casings.

However, recently, in diesel engines, to cope with exhaust gas regulations, a valve moving mechanism of a multi-valve type has been developed. For example, a valve moving mechanism of the double overhead camshaft (DOHC) type having, for each cylinder, two intake valves driven by an intake-side camshaft and two exhaust valves driven by an exhaust-side camshaft has been developed. Thus, in engines having a valve moving mechanism where valve lifter casings for four valves arranged at each cylinder and two camshafts are arranged above the cylinder head, room for arranging both the fuel injection nozzle and the fuel distributing pipe on or above the cylinder head is scarce.

Therefore, the arrangement of the fuel distributing pipe has become complicated. During engine maintenance when, for example, the fuel injection nozzle is disconnected and reconnected, removal of not only the fuel distributing pipe but also the camshafts is required, and consequently, engine maintenance is much more difficult.

A solution for this problem has been proposed in Japanese Unexamined Utility Model Publication No. Hei 1-124365. In this proposal, the cylinder head is provided with a lower insertion hole for a fuel supply pipe, which supplies fuel to a fuel injection nozzle, and an upper insertion hole for a fuel return pipe, which returns excess fuel to the fuel tank. The fuel supply pipe is connected to a lower threaded hole of the fuel injection nozzle, and the fuel return pipe is connected to an upper threaded hole of the fuel injection nozzle.

Therefore, in this proposal, the fuel distributing pipe is not arranged on the cylinder head and, for example, even when the fuel injection nozzle is detached, the camshaft and the fuel distributing pipe need not be removed.

However, in the fuel distributing pipe structure of this proposal, the upper and lower insertion holes are formed by processing the cylinder head with a machine, and consequently, manufacturing costs are high. In addition, because the fuel supply pipe is inserted into the cylinder head, the heat of the cylinder head is transferred to the fuel supply tube, the air-fuel ratio may become unstable due to evaporation of the fuel in the fuel supply pipe.

As described above, the fuel supply pipe should be connected to the lower end of the fuel injection nozzle, and in an engine with a valve moving mechanism of a multi-valve type, the space between valve lifter casings is narrow. Therefore, it is physically difficult to connect the fuel distributing pipe to the fuel injection nozzle when using a normal fuel injection nozzle.

SUMMARY OF THE INVENTION

Accordingly, it is a primary object of the present invention to provide a fuel distributing structure which is capable of readily mounting the fuel injection nozzle in a central position between valves in an internal combustion engine with a multi-valve type valve moving mechanism.

Another object of the present invention is to provide a fuel distributing structure which is capable of suppressing variations in air-fuel ratio resulting from engine heat.

To achieve the foregoing and other objects and in accordance with the purpose of the present invention, a fuel supply apparatus is provided. The fuel supply apparatus for supplying fuel to a combustion chamber of an internal combustion engine has a pair of intake valves and a pair of exhaust valves, a cam apparatus, an elongated injection nozzle, and a fuel supply pipe. The engine has a head for covering said combustion chamber with intake and exhaust ports formed therein. The pair of intake valves and a pair of exhaust valves are disposed adjacent to the combustion chamber. The cam apparatus drive said intake valves and exhaust valves, and include at least one camshaft. The elongated injection nozzle is located between said pair of intake valves and exhaust valves, and has an injection orifice at one end. A fuel supply orifice is located approximately midway along the injection nozzle and closely adjacent to said head. The fuel supply pipe is connected said fuel supply port, and extends over a side of said camshaft that is opposite to said head.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiment together with the accompanying drawings in which:

DETAILED DESCRIPTION OF THE PREFERRED EMBODIMENT

Figure 1:
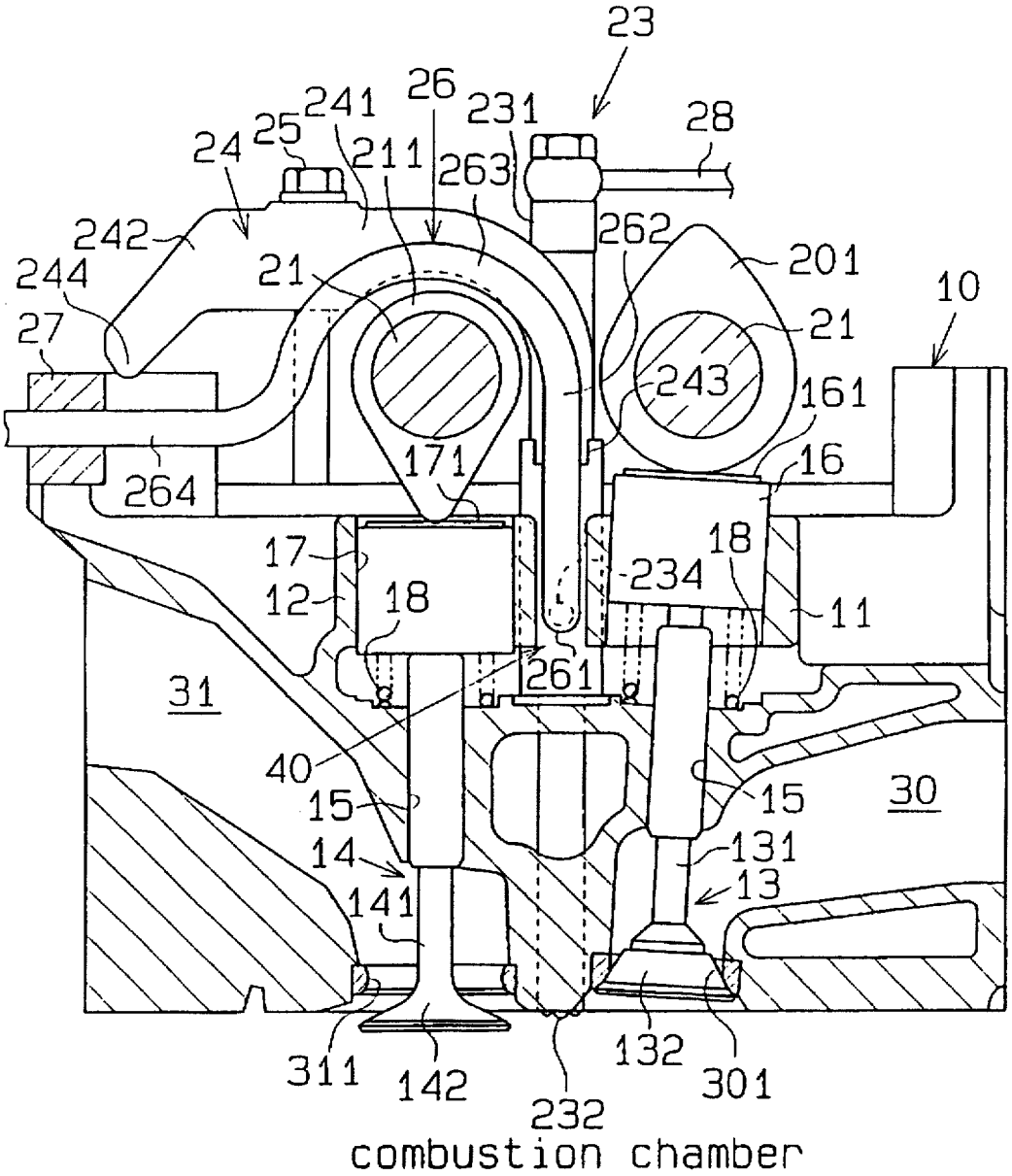
FIG. 1 is an enlarged cross sectional view of an internal combustion engine cylinder head showing a fuel distributing pipe structure according to the present invention.
Figure 2:
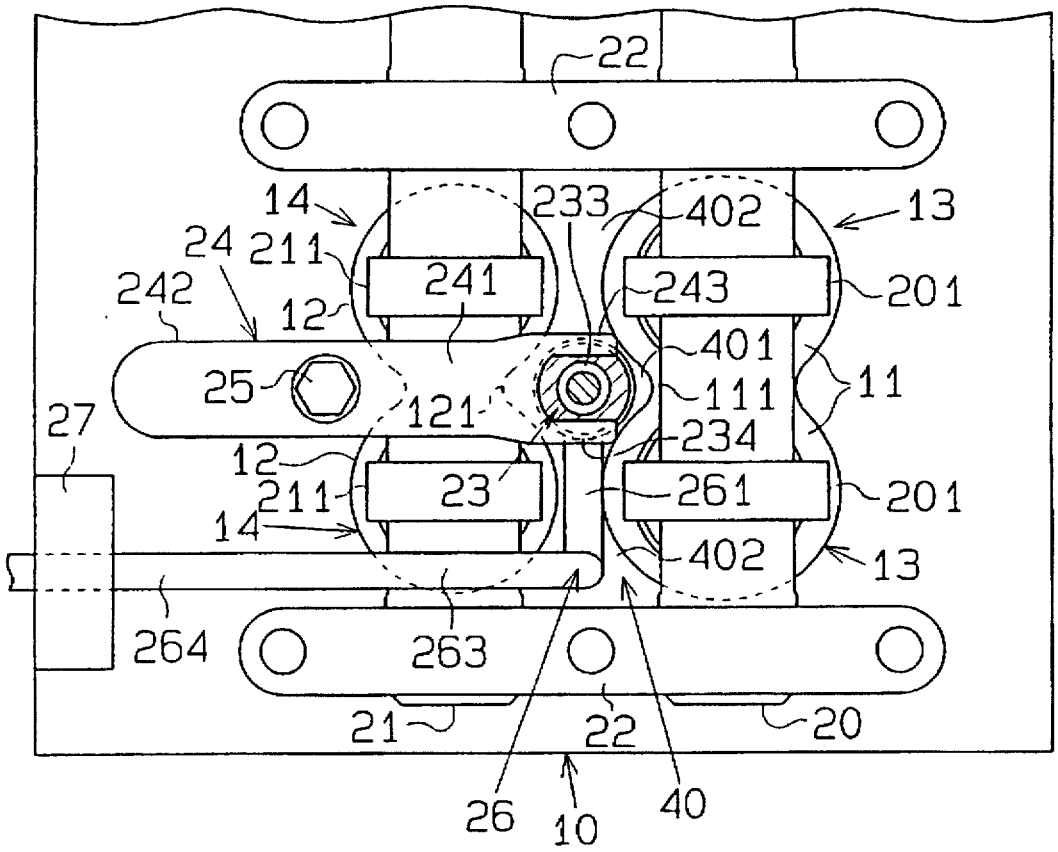
FIG. 2 is a plan view of the cylinder head of FIG. 1.

Referring now in detail to FIGS. 1 and 2, a preferred fuel distributing pipe structure constructed in accordance with the present invention is illustrated. The internal combustion engine has a double overhead camshaft (DOHC), for actuating the valves, which is known as a 4-valve direct drive type. Initially, the valve moving mechanism will be described in reference to FIGS. 1 and 2.

A cylinder head 10 with a single intake port 30, a single exhaust port 31, a pair of double cylindrical valve lifter casings 11 and 12, and valve guides 15 for communicating the port 30 with the casing 11 and communicating the port 31 with the casing 12 is provided. In addition, a pair of intake valves 13 and a pair of exhaust valves 14 are provided for each of the cylinders (not shown) so that they can each be reciprocated. More particularly, valve stems 131 and 141 are supported by the valve guides 15 so that the stems can reciprocate.

Facing a cylinder block (not shown), a valve seat 301, with which a valve face 132 of the intake valve 13 cooperates, is provided. Likewise, facing the cylinder block, a valve seat 311, with which a valve face 142 of the exhaust valve 14 cooperates, is provided.

Above the cylinder head 10, an intake-side camshaft 20 and an exhaust-side camshaft 21 are rotatably supported by bearings 22 (FIG. 2). Fixed on the intake-side camshaft 20 are intake cams 201, each cooperating with one of the intake valves 13. Likewise, fixed on the exhaust-side camshaft 21 are exhaust cams 211, each cooperating with one of the exhaust valves 14.

A valve lifter 16 for transferring motion of the intake cam 201 to the intake valve 13 and a valve lifter 17 for transferring motion of the exhaust cam 211 to the intake valve 14 are housed in the valve lifter casings 11 and 12, respectively, so that the valve lifters 16 and 17 can be reciprocated.

Fixed on the other faces of the valve lifters 16 and 17, are shims 161 and 171 for directly contacting the cams 201 and 211. The valve opposite or lower of the valve lifters 16 and 17, engage the valve stems 131 and 141. Around the valve stems 131 and 141, springs 18 are located between retainers (not shown) in the upper ends of the valve lifters 16, 17 and the cylinder head 10 as shown in FIG. 1.

The valve faces 132 and 142 are urged toward contact with the valve seats 301 and 311 at all times by the elastic forces of the valve springs 18. When one of the lobes of the cams 201, 211 points upward, the associated port 30 or 31 is closed as illustrated with the intake valve 13 of FIG. 1. However, when one of the cam lobes points downward, the associated valve lifter 16, 17 is pushed down against the elastic forces of the associated valve spring 18 to open the associated port as illustrated with the exhaust valve 14 in FIG. 1. Thus, as the cam shafts 20, 21 rotate, the intake and exhaust ports 30 and 31 will be repeatedly opened and closed.

Between the valve lifter casings 11 and 12, a narrow space 40 is defined as shown in FIG. 2. The space 40 consists of a central space 401 corresponding to depressions 111 and 121 formed in the valve lifter casings 11 and 12 and side spaces 402 extending from the central space 401 to the opposite ends of each of the valve lifter casings 11 and 12.

A fuel injection nozzle, generally designated by reference numeral 23, has a small diameter main body 231 that can be inserted into the narrow and small space 401. The fuel injection nozzle 23 has a fuel injection orifice 232 at its lower end, a fuel return portion 233 at its upper end, and a fuel supply port 234 at a position nearly intermediate between the fuel injection orifice 232 and the fuel return port 233. This fuel injection nozzle 23 is arranged so that the fuel injection orifice 232 is exposed to a fuel chamber (not shown) from between the valve seats 301 and 311 mounted in the cylinder head 10 through the central space 401.

The fuel supply port 234 is positioned in the vicinity of the lower ends of the valve lifter casings 11 and 12 and is arranged within the central space 401. The fuel return port 233, formed in the upper end of the fuel injection nozzle 23, is positioned above a plane including the axes of the camshafts 20 and 21.

The fuel injection nozzle 23 is fixed to the cylinder head 10 by a nozzle clamp 24 held to the cylinder head 10 with a support bolt 25. This nozzle clamp 24 has a first arm 241 and a second arm 242. One end of the first arm 241 is formed into a bifurcated clamp portion 243, which serves to clamp the main body 231 of the fuel injection nozzle 23, as shown in FIG. 2.

The first arm 241 extends from the top of the exhaust-side camshaft 21 and in between the camshafts 20 and 21 and then leads to the main body 231 of the fuel injection nozzle 23. The clamp portion 243 of the first arm 241 clamps the main body 231. The second arm 242 extends leftward as viewed in FIG. 1, and a fulcrum portion 244 of the outer end of the second arm 242 contacts the cylinder head 10. As a consequence, the fuel injection nozzle 23 is firmly fixed to the cylinder head 10.

A fuel supply pipe 26 for supplying fuel to the fuel injection nozzle 23 extends, in the side space 402, from the fuel supply port 234, where the distal end of the pipe 26 is connected, to the vicinity of the bearing 22 in a parallel relationship with the camshafts 20 and 21, as shown in FIG. 2. Then, the fuel supply pipe 26 is bent at an angle of approximately 90 degrees and extends vertically upward to the vicinity of the camshafts 20 and 21, as shown in FIG. 1. The portion extending in a parallel relationship with the camshafts 20 and 21 (FIG. 2) is a first horizontal portion 261 and the portion extending vertically from the vicinity of the bearing 22 (FIG. 1) is a vertical portion 262.

The fuel supply pipe 26 further extends from the vertical portion 262 along a semi-circular path over the exhaust camshaft 21. Thereafter, the fuel supply pipe 26 extends to the vicinity of the surface of the cylinder head 10. Then, the fuel supply pipe 26 is bent at an angle of nearly 90 degrees and extends towards the exhaust system side (left side in FIG. 1) of the cylinder head 10 in a parallel relationship with the cylinder head 10. Let the curved portion extending above the exhaust camshaft 21 be a curved portion 263, and let the portion extending parallel to the cylinder head 10 be a second horizontal portion 264.

The second horizontal portion 264 of the fuel supply pipe 26 is fixed at the exhaust system side (left side in FIG. 1) of the cylinder head 10 to the cylinder head 10 with a grommet (rubber tube) 27, which is fixed with a fastener (not shown).

A fuel return pipe 28 is connected to the fuel return port 233 of the fuel injection nozzle 23.

As has been described hereinbefore, in the aforementioned embodiment, the fuel supply pipe 26 and the fuel return pipe 28 have not been inserted into the cylinder head 10, unlike the prior art. Therefore, these pipes need not be specially machined and manufacturing costs are thus kept low.

In addition, since the fuel supply pipe 26 and the fuel return pipe 28 are spaced from each other above the cylinder head 10, the evaporation of the fuel inside the fuel supply pipe 26, which is caused by heat transferred from the cylinder head 10, is suppressed. Accordingly, disturbances in the air-fuel ratio are avoided.

Furthermore, the fuel supply pipe 26 is spaced from the valves 13 and 14 by means of the first horizontal portion 261 and has been arranged so as not to interfere with the camshafts 20 and 21 by means of the vertical portion 262 and the curved portion 263. With this arrangement, the fuel supply port 234 is located in a position adjacent to the fuel injection orifice 232, i.e., the fuel supply port 234 is located on the lower side of the nozzle's main body 231. Consequently, the internal structure of the fuel injection nozzle 23 is simple and its machining can be readily performed.

Moreover, in accordance with the aforementioned embodiment, the fuel supply pipe 26 and the fuel return pipe 28 are located so as not to interfere with the camshafts 20 and 21, and consequently, the camshafts 20 and 21 need not be disturbed in detaching the fuel injection nozzles 23, which is frequently done for adjustment and replacement. Particularly in DOHC engines with a large. number of components, it is highly desirable that the removal of the camshafts 20 and 21 arranged above the cylinder head 10 be unnecessary during most maintenance procedures. The fuel distributing pipe structure according to the present invention meets this demand.

Moreover, because the fuel injection nozzle 23 and the fuel supply pipe 26 are both detachable, adjustment and replacement of the fuel injection nozzle 23 is easily performed. In addition, the fuel supply pipe 26 is supported by the fuel supply port 234 of the fuel injection nozzle 23 and the grommet 27, and is thus firmly held.

Although only one embodiment of the present invention has been described herein, it should be apparent to those skilled in the art that the present invention may be embodied in many other specific forms without departing from the spirit or scope of the invention. Particularly, it should be understood that the invention may be embodied in the following modes:

(1) The space 40 between the valve lifter casings 11 and 12 is preferably formed by casting or machine working, but when the gap of the space 40 is narrow as compared with the outer diameter of the fuel supply pipe 26, the gap of the space 40 may be made wider by cutting out the opposed faces of the valve lifter casings 11 and 12.

(2) While the aforementioned embodiment has been described with reference to the valve moving mechanism of 4-valve direct drive type DOHC arrangement, the present invention can be applied to a valve moving mechanism of a 4-valve swing arm type DOHC arrangement or a 4-valve locker arm type DOHC arrangement.

Therefore, the present embodiment is to be considered as illustrative and not restrictive and the invention is not to be limited to the details given herein, but may be modified within the scope of the appended claims.

What is claimed is:

1. A fuel supply apparatus for supplying fuel to a combustion chamber of an internal combustion engine, said engine having a head for covering said combustion chamber with intake and exhaust ports formed therein, said fuel supply apparatus comprising:

a pair of intake valves and a pair of exhaust valves disposed adjacent to the combustion chamber;

a cam apparatus for driving said intake valves and said exhaust valves, said cam apparatus including at least one camshaft;

an elongated injection nozzle located between said pair of intake valves and exhaust valves, wherein said injection nozzle has an injection orifice at one end, and a fuel supply orifice located approximately midway along the injection nozzle and closely adjacent to said head;

a pair of valve lifters respectively disposed in association with said intake valves and said exhaust valves;

a fuel supply pipe connected to said fuel supply orifice, wherein said fuel supply pipe extends between said valve lifters; and a nozzle clamp for fixing said injection nozzle to said head, said nozzle clamp perpendicularly extending to said fuel supply pipe.

2. A fuel supply apparatus for supplying fuel to a combustion chamber of an internal combustion engine, said engine having a head for covering said combustion chamber with intake and exhaust ports formed therein, said fuel supply apparatus comprising:

a pair of intake valves and a pair of exhaust valves disposed adjacent to the combustion chamber;

a cam apparatus for driving said intake valves and exhaust valves, said cam apparatus including at least one camshaft;

an elongated injection nozzle located between said pair of intake valves and exhaust valves, wherein said injection nozzle has an injection orifice at one end, and a fuel supply orifice located approximately midway along the injection nozzle and closely adjacent to said head;

a pair of valve lifters respectively disposed in association with said intake valves and said exhaust valves;

a fuel supply pipe connected to said fuel supply orifice, wherein said fuel supply pipe extends over a side of said camshaft that is opposite to said head and includes a first portion extending generally parallel to said head from said fuel supply orifice and between said valve lifters, a second portion extending generally away from said head to said camshaft, a third curved portion curving around said camshaft, and a fourth portion connected to said third curved portion and extending generally parallel to said head; and a nozzle clamp for fixing said injection nozzle to said head, said nozzle clamp perpendicularly extending to said fuel supply pipe.

3. The fuel supply apparatus as set forth claim 2, wherein said cam apparatus includes an intake camshaft for driving said intake valves, and an exhaust camshaft for driving said exhaust valves.

4. A fuel supply apparatus having a plurality of injection nozzles for supplying fuel to an array of combustion chambers of an internal combustion engine, and a plurality of fuel supply pipes for supplying the fuel to each injection nozzle, said fuel supplying apparatus comprising:

intake valves and exhaust valves disposed above each combustion chamber;

a cam mechanism extending along the array of combustion chambers, wherein said cam mechanism drives said intake valves and exhaust valves;

an injection nozzle located between said intake valves and exhaust valves at each combustion chamber, wherein said injection nozzle is elongated and has an injection orifice at one end and a fuel supply port at a location approximately midway along its length;

a pair of valve lifters respectively disposed in association with said intake valves and said exhaust valves;

a fuel supply pipe connected to said fuel supply port, wherein said fuel supply pipe extends between said valve lifters; and a nozzle clamp for fixing said injection nozzle to the engine head, said nozzle clamp perpendicularly extending to said fuel supply pipe.

5. A fuel supply apparatus having a plurality of injection nozzles for supplying fuel to an array of combustion chambers of an internal combustion engine, and a plurality of fuel supply pipes for supplying the fuel to each injection nozzle, said fuel supplying apparatus comprising:

intake valves and exhaust valves disposed above each combustion chamber;

a cam mechanism extending along the array of combustion chambers, wherein said cam mechanism drives said intake valves and exhaust valves;

an injection nozzle located between said intake valves and exhaust valves at each combustion chamber, wherein said injection nozzle is elongated and has an injection orifice at one end and a fuel supply port at a location approximately midway along its length;

a pair of valve lifters respectively disposed in association with said intake valves and said exhaust valves;

a fuel supply pipe connected to said fuel supply port, wherein said fuel supply pipe extends over a side of said cam mechanism that is opposite to said head and includes a first portion extending generally parallel to said head from said fuel supply port and between said valve lifters, a second portion extending generally away from said head to said camshaft, a third curved portion curving around said camshaft, and a fourth portion connected to said third curved portion and extending generally parallel to said head; and a nozzle clamp for fixing said injection nozzle to said head, said nozzle clamp perpendicularly extending to said fuel supply pipe.

6. The fuel supply apparatus as set forth claim 5, wherein said cam mechanism includes an intake camshaft for driving said intake valves, and an exhaust camshaft for driving said exhaust valves.

7. The fuel supply apparatus as set forth claim 6 further comprising:

intake valve casings for guiding each intake valve.

8. The fuel supply apparatus as set forth claim 6 further comprising:

exhaust valve casings for guiding each exhaust valve.

9. The fuel supply apparatus as set forth claim 6 further comprising:

an intake valve casings for guiding each intake valve and an exhaust valve casings for guiding each exhaust valve.

10. The fuel supply apparatus as set forth claim 9, wherein the intake valve casings and exhaust valve casings define an opening in said head corresponding to each combustion chamber.

11. The fuel supply apparatus as set forth claim 10, wherein one of said injection nozzles is located in each opening.

12. A fuel supply apparatus having a plurality of injection nozzles for supplying fuel to an array of combustion chambers of an internal combustion engine, and a plurality of fuel supply pipes for supplying the fuel to each injection nozzle, said fuel supplying apparatus comprising:

intake valves and exhaust valves disposed above each combustion chamber;

intake valve casings for guiding each intake valve and exhaust valve casings for guiding each exhaust valve;

an intake camshaft extending along the array of combustion chambers, wherein said intake camshaft drives said intake valves;

an exhaust camshaft extending along the array of combustion chambers, wherein said exhaust camshaft drives said exhaust valves;

an injection nozzle located in an opening defined by said intake valves and exhaust valves at each combustion chamber, wherein said injection nozzle is elongated and has an injection orifice at one end, and a fuel supply port located within said opening;

a pair of valve lifters respectively disposed in association with said intake valves and said exhaust valves;

a fuel supply pipe including a first portion extending generally parallel to said head from said fuel supply port and between said valve lifters, a second portion extending generally away from said head to said camshaft, a third curved portion curving around said camshaft, and a fourth portion connected to said third curved portion and extending generally parallel to said head; and a nozzle clamp for fixing said injection nozzle to said head, said nozzle clamp perpendicularly extending to said fuel supply pipe.

13. The fuel supply apparatus as set forth claim 12 further comprising:

a device for fixing said fourth portion to said head.

14. A fuel supply apparatus for supplying fuel to a combustion chamber of an internal combustion engine, said engine having a head for covering said combustion chamber with intake and exhaust ports formed therein, said fuel supply apparatus comprising:

a pair of intake valves and a pair of exhaust valves disposed adjacent to the combustion chamber;

a cam apparatus for driving said intake valves and exhaust valves, said cam apparatus including at least one camshaft;

an elongated injection nozzle located between said pair of intake valves and exhaust valves, wherein said injection nozzle has an injection orifice at one end, and a fuel supply orifice located approximately midway along the injection nozzle and closely adjacent to said head;

a pair of valve lifters respectively disposed in association with said intake valves and said exhaust valves;

a fuel supply pipe connected to said fuel supply orifice, wherein said fuel supply pipe includes a first portion extending from the fuel supply orifice generally parallel to said at least one camshaft and between said valve lifters; and a nozzle clamp for fixing said injection nozzle to said head, said nozzle clamp perpendicularly extending to said fuel supply pipe.

15. The apparatus as set forth in claim 1 wherein said fuel supply pipe extends to a position corresponding to an end of said valve lifters.

16. The apparatus as set forth in claim 15 wherein said fuel supply pipe extends upward from the position corresponding to an end of said valve lifters.

17. The apparatus as set forth in claim 2 wherein said first portion of said fuel supply pipe extends to a position corresponding to an end of said valve lifters.

18. The apparatus as set forth in claim 17 wherein said second portion of said fuel supply pipe extends upward from the position corresponding to an end of said valve lifters.

19. The apparatus as set forth in claim 4 wherein said fuel supply pipe extends to a position corresponding to an end of said valve lifters.

20. The apparatus as set forth in claim 19 wherein said fuel supply pipe extends upward from the position corresponding to an end of said valve lifters.

21. The apparatus as set forth in claim 5 wherein said first portion of said fuel supply pipe extends to a position corresponding to an end of said valve lifters.

22. The apparatus as set forth in claim 21 wherein said second portion of said fuel supply pipe extends upward from the position corresponding to an end of said valve lifters.

23. The apparatus as set forth in claim 12 wherein said first portion of said fuel supply pipe extends to a position corresponding to an end of said valve lifters.

24. The apparatus as set forth in claim 23 wherein said second portion of said fuel supply pipe extends upward from the position corresponding to an end of said valve lifters.

25. The apparatus as set forth in claim 14 wherein said first portion of said fuel supply pipe extends to a position corresponding to an end of said valve lifters.

26. The apparatus as set forth in claim 25 wherein said fuel supply pipe extends upward from the position corresponding to an end of said valve lifters.

* * * * *